US007094037B2

(12) United States Patent
Nakamura et al.

(10) Patent No.: US 7,094,037 B2
(45) Date of Patent: Aug. 22, 2006

(54) OIL-COOLED COMPRESSOR

(75) Inventors: Hajime Nakamura, Kako-gun (JP); Junichiro Totsuka, Kako-gun (JP); Shoji Yoshimura, Takasago (JP)

(73) Assignee: Kobe Steel, Ltd., Kobe (JP)

( * ) Notice: Subject to any disclaimer, the term of this patent is extended or adjusted under 35 U.S.C. 154(b) by 385 days.

(21) Appl. No.: 10/449,113

(22) Filed: Jun. 2, 2003

(65) Prior Publication Data

US 2003/0223885 A1 Dec. 4, 2003

(30) Foreign Application Priority Data

Jun. 3, 2002 (JP) ..... 2002-161721

(51) Int. Cl.
*F04B 49/00* (2006.01)

(52) U.S. Cl. ..... 417/63; 417/139; 417/412; 417/313; 417/228

(58) Field of Classification Search ..... 417/228, 417/313, 142, 139, 63
See application file for complete search history.

(56) References Cited

U.S. PATENT DOCUMENTS 4,054,401 A 10/1977 Andriulis
4,336,001 A * 6/1982 Andrew et al. ..... 417/63
4,526,523 A * 7/1985 Parker ..... 418/84
5,310,020 A * 5/1994 Martin et al. ..... 184/6.3
5,522,233 A * 6/1996 Nares et al. ..... 62/193
5,626,470 A * 5/1997 Gerhardt ..... 418/84

FOREIGN PATENT DOCUMENTS

JP 4-128585 4/1992
JP 8-4679 1/1996

* cited by examiner

*Primary Examiner*—Tae Jun Kim
*Assistant Examiner*—Ryan Gillan
(74) *Attorney, Agent, or Firm*—Oblon, Spivak, McClelland, Maier & Neustadt, P.C.

(57) ABSTRACT

An oil-cooled screw compressor which can maintain the discharge temperature of discharge gas at an appropriate level is provided. The oil-cooled screw compressor comprises a compressor body, an oil separation/recovery unit disposed in a discharge path extending from a discharge port of the compressor body, and an oil feed path extending from the oil separation/recovery unit and communicating with the compressor body 12. The oil feed path is branched at an intermediate position thereof into a first feed path portion and a second feed path portion. An opening/closing valve is disposed in the first feed path portion, a pressure gauge is disposed in the discharge path, and a control unit is provided to control opening and closing of the opening/closing valve on the basis of a correlation between a discharge pressure detected by the pressure gauge and a predetermined pressure.

2 Claims, 4 Drawing Sheets

OIL-COOLED COMPRESSOR

BACKGROUND OF THE INVENTION

1. Technical Field of the Invention

The present invention relates to an oil-cooled compressor which is constructed so that oil is fed to a body of the compressor for lubrication, cooling, or shaft sealing. Particularly, the invention is concerned with an oil-cooled compressor in which the discharge temperature of discharge gas is controlled appropriately by controlling the amount of oil to be fed.

2. Description of the Related Art

There is known an oil-cooled compressor constructed such that oil is fed to a body of the compressor for lubrication, cooling, or shaft sealing. An example in which this known oil-cooled compressor is an oil-cooled screw compressor will now be described with reference to drawings attached hereto. FIG. 4 is a schematic system diagram of an oil-cooled screw compressor, FIG. 5 is a graph explaining a relation between a discharge pressure $P_d$ and a power w of a compressor body and a relation between the discharge pressure $P_d$ and an oil quantity q, and FIG. 6 is a graph explaining a relation between the discharge pressure $P_d$ and a discharge temperature $T_d$.

A description will first be given of a conventional oil-cooled screw compressor. The numeral 2 in FIG. 4 denotes an oil-cooled screw compressor. The screw compressor 2 is provided with a compressor body 12 in which a pair of intermeshing male and female screw rotors 11 is accommodated rotatably. A discharge path 13 extends from a discharge port of the compressor body 12, and an oil separation/recovery unit 14 as an oil separating means is disposed in the discharge path 13. An oil separating unit 15 is provided at an upper position within the oil separation/recovery unit 14. A lower portion of the oil separation/recovery unit 14 serves as an oil sump 16 for staying therein of oil after separation by the oil separating element 15. On one end of an oil feed path 18 with an oil cooler 17 disposed therein is connected to the oil sump 16, while the opposite end thereof is in communication with the compressor body 12.

Thus, the oil-cooled screw compressor 2 is constructed so that oil which has flowed through the oil feed path 18 from the oil sump 16 in the oil separation/recovery unit 14 and cooled by the oil cooler 17 is fed to a rotor chamber, bearings and a shaft sealing portion located within the compressor body 12. (The rotor chamber, bearings and a shaft sealing portion are not shown in the figures) An oil quantity q of oil fed to the compressor body 12 of the oil-cooled screw compressor 2 varies depending on a discharge pressure $P_d$ of the compressor body 12. A relation between the oil quantity q and the discharge pressure $P_d$ is as shown by the following equation (1). A nozzle area of a communicating portion of the oil feed path 18 for communication with the compressor body 12 is assumed to be S.

$$q=C_1\times S\times(P_d)^{1/2} \tag{1}$$

In the above expression (1), $C_1$ is a constant.

The power w of the compressor body 12 can be calculated by the following equation (2):

$$W=C_2\times\{(V_i-\kappa)/(\kappa-1)\times P_s+P_d/v_i\} \tag{2}$$

In the equation (2), $C_2$ is a constant, $v_i$ is an internal volume ratio, κ is a specific heat ratio of air, $P_S$ is a suction pressure. The oil quantity q and power w of the compressor body 12 vary as shown schematically in FIG. 5. The discharge temperature $T_d$ can be calculated from the following equation (3):

$$T_d=w/(C_3\times q)+T_o \tag{3}$$

In the equation (3), $T_o$ is a feed oil temperature and $C_3$ is a constant.

From the equations (1) and (2) it is seen that the oil quantity q is in a linear relation to the square root of the discharge pressure $P_d$, while the power w is in a linear relation to the discharge pressure $P_d$ itself. From this fact it can be said that with respect to increase and decrease of the same discharge pressure $P_d$, the ratio of the increase and decrease quantity q of oil fed to the compressor body is larger than that of the power w. Further, from the equation (3) it can be said qualitatively that the discharge temperature $T_d$ rises as the discharge pressure $P_d$ decreases, as shown in FIG. 6.

As to the discharge pressure $P_d$ in the compressor body of the oil-cooled compressor, a maximum discharge pressure $P_{dmax}$ is established in relation to the specification of the oil-cooled compressor. A higher pressure than $P_{dmax}$ cannot (or does not) exist. There also is established a lowest discharge pressure $P_{dmin}$. A lower pressure than $P_{dmin}$ cannot (or does not) exist.

As to the discharge temperature $T_d$ of discharge gas discharged from a discharge port formed in the compressor body of the oil-cooled compressor, there are established a desirable upper-limit discharge temperature $T_{dmax}$ and a desirable lower-limit discharge temperature $T_{dmin}$. Generally, the upper-limit discharge temperature $T_{dmax}$ is established (e.g., 100° C.) for preventing the deterioration of oil, and the lower-limit discharge temperature $T_{dmin}$ is established for preventing the deposition of drain on the discharge side of the compressor body (e.g., 80° C.).

In order to ensure the lower-limit discharge temperature $T_{dmin}$ at the upper-limit discharge temperature $T_{dmax}$, a corresponding value of oil quantity q is determined so as to bring about this state and the discharge pressure $P_d$ is decreased in the state of that oil quantity q. As a result, the discharge temperature $T_d$ drops for the reason stated above in connection with the equations (1), (2) and (3). At the initial stage, a certain degree of temperature rise does not give rise to any problem because the discharge temperature is set to the lower-limit discharge temperature $T_{dmin}$. As to a more increase of temperature, there can be a case where the temperature rises up to near the upper-limit discharge temperature $T_{dmax}$ or may exceed the upper-limit discharge temperature, which would cause inconvenience in the operation of the compressor body.

It is preferable for preventing the deterioration of oil that the temperature of oil fed to the compressor body of the oil-cooled compressor be lower than the upper-limit discharge temperature $T_{dmax}$, more preferably be maintained at a low temperature. Also, for preventing the deposition of drain from the compressed gas, it is preferable that the oil temperature be kept higher than and close to the lower-limit discharge temperature $T_{dmin}$.

Japanese laid-open patent gazette JP-8-4679-A discloses control of the discharge temperature of a compressor in order to prevent the production of drain. However, the compressor in the prior document has a complicated structure which additionally includes a discharge temperature sensor and an oil control valve changing supply oil quantity continuously. In addition, though it is assumed that a complicated control algorithm should be applied for thus complicated structure, the prior document discloses nothing about the control algorithm.

SUMMARY OF THE INVENTION

Accordingly, it is an object of the present invention to provide an oil-cooled compressor which can maintain the discharge temperature of discharge gas at an appropriate level effectively in a simple way.

The present invention has been accomplished in view of the above-mentioned circumstances, and for solving the above-mentioned problem. An oil-cooled compressor according to the present invention comprises a compressor body, a discharge path extending from a discharge port of the compressor body, oil separating means disposed in the discharge path, an oil feed path for communicating the oil separating means to an oil feed portion of the compressor body so as to feed oil separated by the oil separating means to the compressor body, which is branched at an intermediate position thereof into a first feed path portion and a second feed path portion, opening/closing means interposed in the first feed portion, pressure detecting means for detecting a discharge pressure which is disposed in the discharge path; and control means for controlling opening and closing of the opening/closing means on the basis of a relation between the discharge pressure detected by the pressure detecting means and a predetermined pressure value.

Further, in the present invention, given that nozzle areas in communicating portions of the first and second feed path portions for communication with the compressor body are $S_1$ and $S_2$, an oil quantity in which a discharge temperature $T_d$ becomes a lower-limit discharge temperature $T_{dmin}$ in a state of a discharge pressure $P_d$ being a highest discharge pressure $p_{dmax}$, is $q_0$, the discharge pressure $P_d$ and an oil quantity in a state of the discharge pressure $P_d$ being decreased from this condition and the discharge temperature $T_d$ reaching an upper-limit discharge temperature $T_{dmax}$, are P1 and q1, respectively, and an oil quantity in which the discharge temperature $T_d$ becomes the upper-limit discharge temperature $T_{dmax}$ in a state of the discharge pressure $P_d$ being a lowest discharge pressure $P_{dmin}$, is $q_3$, the $S_1$ and $S_2$ are set so that equations $q_1=C_1\times S_1\times(P1)^{1/2}$ and $q_3=C_1\times(S_1+S_2)\times(P_{dmin})^{1/2}$, both including a constant $C_1$, are established.

In the conventional oil-cooled compressor, a decrease of the discharge pressure $P_d$ leads to a mere increase of the discharge temperature $T_d$. However, in the case of the oil-cooled compressor according to the present invention, by controlling the opening/closing means disposed in the first feed path to control the oil quantity q, the discharge temperature $T_d$ of the gas discharged from the discharge port of the compressor body can be varied stepwise when the discharge pressure $P_d$ has reached a predetermined value, i.e., $P_1$. Consequently, the discharge temperature $T_d$ does not exceed the upper-limit discharge temperature $T_{max}$ even when the discharge pressure $P_d$ drops, and hence it is possible to let the oil-cooled compressor continue operation stably. Besides, it is possible to prevent the occurrence of various inconveniences in operation which are caused by the discharge temperature exceeding the upper-limit discharge temperature $T_{dmax}$.

According to the construction of present invention, the discharge temperature of discharge gas can be maintained at an appropriate level effectively in a simple way, by using pressure detecting means for detecting a discharge pressure with which a usual compressor is equipped, and opening/closing means interposed in the branched oil feed path as the only additional component.

DESCRIPTION OF THE PREFERRED EMBODIMENTS

An example in which the oil-cooled compressor according to an embodiment of the present invention is an oil-cooled screw compressor will be described hereinunder with reference to drawings attached hereto.

Figure 1:
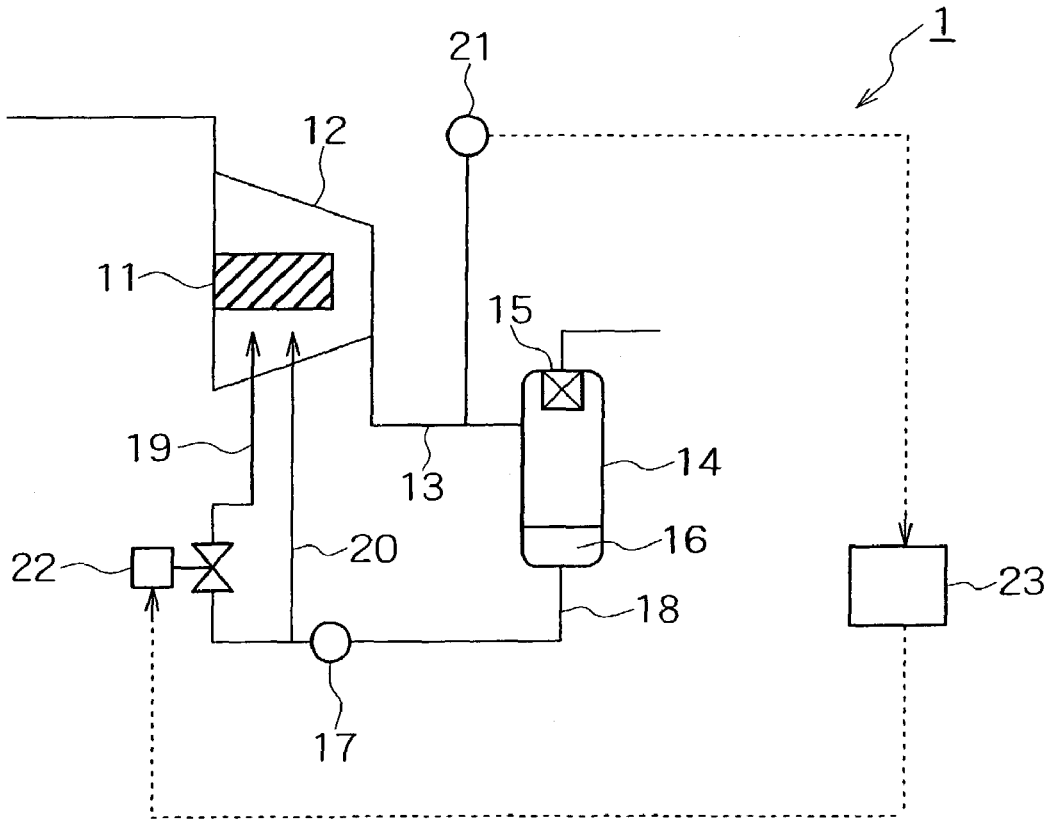
FIG. 1 is a schematic system diagram of an oil-cooled screw compressor according to an embodiment of the present invention.
Figure 2:
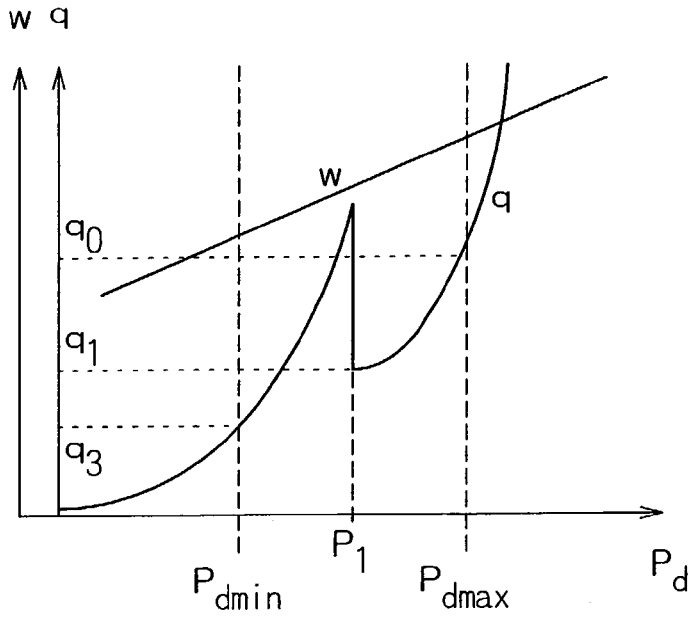
FIG. 2 is a graph related to the embodiment and explaining a relation between a discharge pressure $P_d$ and power w of a compressor body and a relation between the discharge pressure $P_d$ and an oil quantity q.
Figure 3:
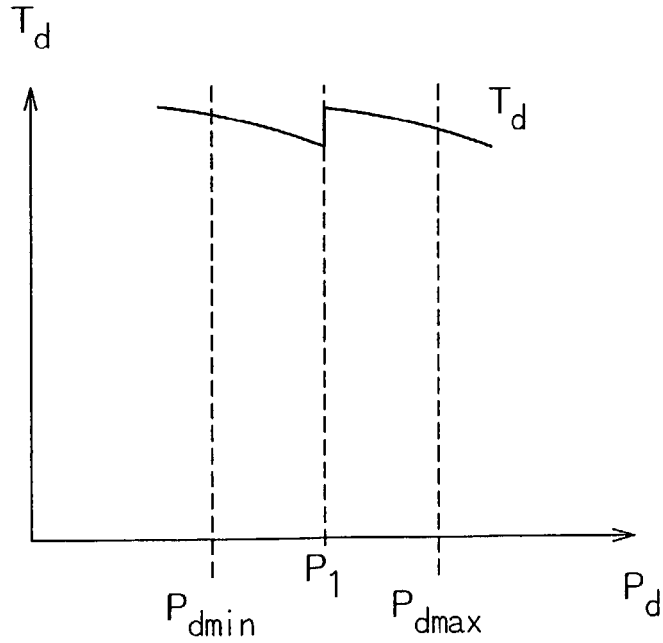
FIG. 3 is a graph related to the embodiment and explaining a relation between the discharge pressure $P_d$ and a discharge temperature $T_d$.
Figure 4:
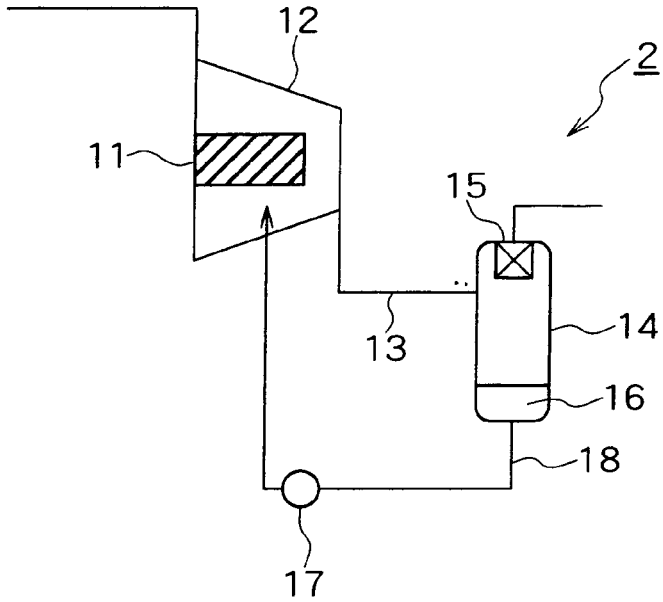
FIG. 4 PRIOR ART
FIG. 4 is a schematic system diagram of a conventional oil-cooled screw compressor.
Figure 5:
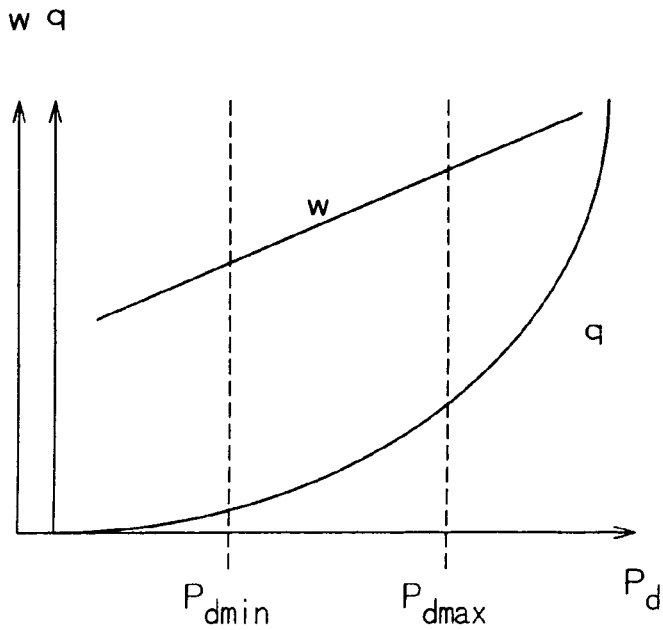
FIG. 5 is a graph related to the prior art and explaining a relation between a discharge pressure $P_d$ and power w of a compressor body and a relation between the discharge pressure $P_d$ and an oil quantity q.
Figure 6:
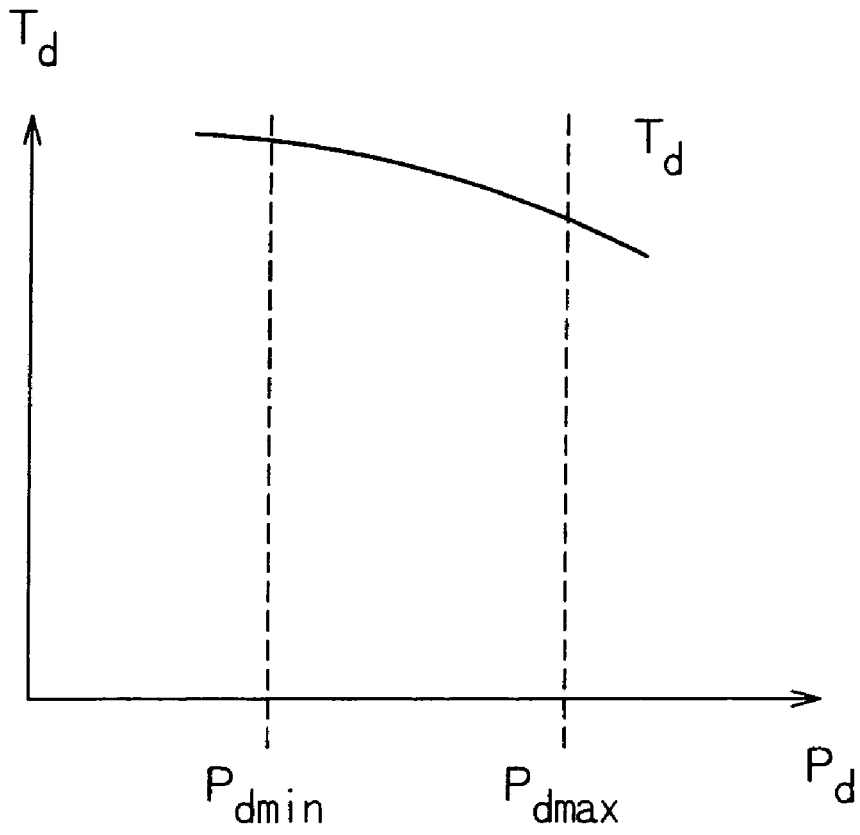
FIG. 6 PRIOR ART
FIG. 6 is a graph related to the prior art and explaining a relation between the discharge pressure $P_d$ and a discharge temperature $T_d$.

FIG. 1 is a schematic system diagram of an oil-cooled screw compressor, FIG. 2 is a graph explaining a relation between a discharge pressure $P_d$ and power w of a compressor body and a relation between the discharge pressure $P_d$ and an oil quantity q, and FIG. 3 is a graph explaining a relation between the discharge pressure $P_d$ and a discharge temperature $T_d$. As to portions common to the conventional oil-cooled screw compressor described above in connection with FIG. 4, they are identified by the same reference numerals as those in FIG. 4 and a description will be given of different points.

First, with reference to FIG. 1, an oil-cooled screw compressor 1 according to an embodiment of the present invention will be described. In the oil-cooled screw compressor 1, an oil feed path 18 is branched into a first feed path portion 19 and a second feed path portion 20. In a portion of the oil feed path 18 located upstream of the first and second feed path portions 19, 20, i.e., on an oil separation/recovery unit 14 side which unit serves as an oil separating means, there is disposed an oil cooler 17. Oil cooled by the coil cooler 17 can be fed to a suction-side space, bearings and a shaft seal portion within a rotor chamber formed in a compressor body 12. An opening/closing valve 22 is disposed in the first feed path portion 19 of the oil feed path 18, and a pressure gauge 21 as a pressure detecting means for detecting the discharge pressure $P_d$ is disposed in a discharge path 13 of the oil-cooled compressor 1.

A pressure signal provided from the pressure gauge 21 is applied to a control unit 23 as a control means. Upon receipt of the pressure signal from the pressure gauge 21 the control unit 23 performs an arithmetic operation to be described later in the interior thereof and transmits an opening or closing signal based on the result of the arithmetic operation to the opening/closing valve 22.

It is assumed that nozzle areas in communicating portions of the first and second feed path portions 19, 20 for communication with the compressor body 12 are $S_1$ and $S_2$ and that air is utilized as intake gas. In a state in which the temperature of air as intake gas can be predicted (e.g., 40° C.), the oil quantity in which the discharge temperature $T_d$ becomes the lower-limit discharge temperature $T_{dmin}$ (e.g., 80° C.) in a state of the discharge pressure Pd being the highest discharge pressure $P_{dmax}$, is assumed to be $q_0$. Further, it is assumed that the discharge pressure $P_d$ and an oil quantity in a state of the discharge pressure $P_d$ being decreased from this condition and the discharge temperature Td reaching the upper-limit discharge temperature $T_{dmax}$ (e.g., 100° C.) are $P_1$ and $q_1$, respectively.

The $S_1$ is set so that $P_1$, and $q_1$, are in the following relation to $S_1$:

$$q_1=C_1\times S_1\times(P_1)^{1/2} \quad (C_1\text{: constant})$$

Further, it is assumed that an oil quantity in which the discharge temperature $T_d$ becomes the upper-limit discharge temperature $T_{dmax}$ (e.g., 100° C.) in a state of the discharge pressure $P_d$ being the lowest discharge pressure $P_{dmin}$ is $q_3$. The $S_2$ is set so that the $P_{dmin}$ and $q_3$, are in the following relation to $S_1$ and $S_2$:

$$q_3=C_1\times(S_1+S_2)\times(P_{dmin})^{1/2} \quad (C_1\text{: constant})$$

With this as a premise and on the basis of a change of the discharge pressure $P_d$, more specifically, using the $P_1$ as a threshold value (a predetermined pressure value), further, on the basis of a relation of magnitude between the threshold value $P_1$, and the discharge pressure $P_d$, the operation of the opening/closing valve 22 disposed in the first feed path portion 19 is controlled.

A more specific description will now be given about how to open and close the opening/closing valve 22. With the discharge pressure $p_d<P_1$, the opening/closing valve 22 is opened. With the discharge pressure $P_d=P_1$, the opening/closing valve 22 is kept open, and with the discharge pressure $P_d>P_1$, the opening/closing valve 22 is closed. That is, if the opening/closing valve 22 is opened at a discharge pressure of $P_d<P_1$, oil is fed to the compressor body 12 in an amount of $q\geqq q_3$. At a discharge pressure of $P_d=P_1$, oil is fed in an amount of $q=q_1$. Further, if the opening/closing valve 22 is closed at a discharge pressure of $P_d>P_1$, oil is fed in an amount of $q_1<q<q_0$.

As shown in FIG. 2, the relation of the oil quantity q to the value of the discharge pressure $P_d$ is such that the oil quantity is $q_3$ when the discharge pressure $P_d$ is $P_{dmin}$, and increases beyond $q_1$ and $q_0$ as the discharge pressure $P_d$ rises, but as soon as the discharge pressure $P_d$ reaches $P_1$, there is made control so as to cause an immediate decrease of the oil quantity to $q_1$. Further, the oil quantity becomes larger as the discharge pressure $P_d$ approaches $P_{max}$ beyond $P_1$, and when the discharge pressure $P_d$ reaches $P_{dmax}$, the oil quantity is control to $q_0$.

In accordance with the oil quantity q thus controlled by operation of the opening/closing valve 22, the discharge temperature $T_d$ relative to the discharge pressure $P_d$ drops as the discharge pressure $P_d$ rises and approaches $P_1$ from $P_{dmin}$, as shown in FIG. 3. Then, the moment the discharge pressure $P_d$ reaches $P_{dmax}$, the discharge temperature $T_d$ rises to about the same degree as when the discharge pressure Pd is $P_{dmin}$ then drops as the discharge pressure $P_d$ rises and approaches $P_{dmax}$, and when the discharge pressure $P_d$ reaches $P_{dmax}$, the discharge temperature $T_d$ drops to about the same level as when the discharge pressure $P_d$ is $P_1$.

As described above, in the oil-cooled screw compressor 1 of this embodiment, a decrease quantity of the discharge temperature $T_d$ can be made smaller than in the conventional oil-cooled screw compressor 2. That is, by adjusting the operation of the opening/closing valve 22 to control the oil quantity q, the discharge temperature $T_d$ of the gas discharged from a discharge port of the compressor body 12 can be changed stepwise when the discharge pressure $P_d$ becomes $P_1$, not that the discharge temperature Td merely rises with decrease of the discharge pressure $P_d$. Consequently, even if the discharge pressure $P_d$ drops, the discharge temperature $T_d$ does not exceed the upper-limit discharge temperature $T_{dmax}$, so that the oil-cooled screw compressor 1 can be operated continuously in a stable state. Besides, it is possible to prevent the occurrence of various inconveniences in operation which are attributable to the discharge temperature $T_d$ exceeding the upper-limit discharge temperature $T_{dmax}$.

What is claimed is:

1. An oil-cooled compressor comprising:

a compressor body including a rotor chamber;

a discharge path extending from a discharge port of said compressor body;

oil separating means disposed in said discharge path;

an oil feed path for communicating said oil separating means to an oil feed portion of said compressor body so as to feed oil separated by said oil separating means to said compressor body, said oil feed path being branched at an intermediate position thereof into a first feed path portion connected to supply the oil to a rotor chamber of said compressor body and a second feed path portion;

opening/closing means interposed in said first feed portion;

pressure detecting means for detecting a discharge pressure, said pressure detecting means being disposed in said discharge path; and control means for controlling opening and closing of said opening/closing means on the basis of a relation between the discharge pressure detected by said pressure detecting means and a predetermined pressure value.

2. An oil-cooled compressor comprising:

a compressor body;

a discharge path extending from a discharge port of said compressor body;

oil separating means disposed in said discharge path;

an oil feed path for communicating said oil separating means to an oil feed portion of said compressor body so as to feed oil separated by said oil separating means to said compressor body, said oil feed path being branched at an intermediate position thereof into a first feed path portion and a second feed path portion;

opening/closing means interposed in said first feed portion;

pressure detecting means for detecting a discharge pressure, said pressure detecting means being disposed in said discharge path; and control means for controlling opening and closing of said opening/closing means on the basis of a relation between the discharge pressure detected by said pressure detecting means and a predetermined pressure value, wherein, given that nozzle areas in communicating portions of said first and second feed path portions for communication with said compressor body are $S_1$ and $S_2$, an oil quantity in which a discharge temperature $T_d$ becomes a lower-limit discharge temperature $T_{dmin}$, in a state of a discharge pressure $p_d$ being a highest discharge pressure $P_{dmax}$, is $q_0$, the discharge pressure $P_d$ and an oil quantity in a state of the discharge pressure $P_d$ being decreased from this condition and the discharge temperature $T_d$ reaching an upper-limit discharge temperature $T_{dmax}$, are $P_1$ and $q_1$, respectively, and an oil quantity in which the discharge temperature $T_d$ becomes the upper-limit discharge temperature $T_{dmax}$ in a state of the discharge pressure $P_d$ being a lowest discharge pressure $P_{dmin}$, is $q_3$, said $S_1$, and $S_2$ are set so that equations $q_1=C_1\times S_1\times(P_1)^{1/2}$ and $q_3=C_1\times(S_1+S_2)\times(P_{dmin})^{1/2}$, both including a constant $C_1$, are established.

* * * * *

UNITED STATES PATENT AND TRADEMARK OFFICE

CERTIFICATE OF CORRECTION

PATENT NO. : 7,094,037 B2
APPLICATION NO. : 10/449113
DATED : August 22, 2006
INVENTOR(S) : Nakamura et al.

It is certified that error appears in the above-identified patent and that said Letters Patent is hereby corrected as shown below:

On the title page, Item (73) should read:

-- (73) Assignee: Kabushiki Kaisha Kobe Seiko Sho
(Kobe Steel, Ltd.) Kobe (JP)--

Signed and Sealed this

Twenty-first Day of November, 2006

JON W. DUDAS
*Director of the United States Patent and Trademark Office*